US009869500B2

(12) United States Patent
Goel et al.

(10) Patent No.: US 9,869,500 B2
(45) Date of Patent: Jan. 16, 2018

(54) HEAT PUMP SYSTEM HAVING A PRESSURE TRIP SENSOR RECALCULATION ALGORITHM CONTROLLER

(71) Applicant: Lennox Industries Inc., Richardson, TX (US)

(72) Inventors: Rakesh Goel, Carrollton, TX (US); Eric Berg, Carrollton, TX (US); Pete Hrejsa, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 708 days.

(21) Appl. No.: 14/087,519

(22) Filed: Nov. 22, 2013

(65) Prior Publication Data

US 2015/0143829 A1 May 28, 2015

(51) Int. Cl.

| | |
|---|---|
| ***G01K 13/00*** | (2006.01) |
| ***F25B 49/00*** | (2006.01) |
| ***F25B 13/00*** | (2006.01) |
| ***F25B 49/02*** | (2006.01) |

(52) U.S. Cl.

CPC ..... *F25B 49/00* (2013.01); *F25B 13/00* (2013.01); *F25B 49/02* (2013.01); *F25B 2600/0271* (2013.01); *F25B 2700/1931* (2013.01)

(58) Field of Classification Search

CPC ..... F25B 13/00; F25B 2600/0271; F25B 2700/1931; F25B 49/00; F25B 49/02

USPC ..... 62/129, 159, 160, 228.1, 228.4

See application file for complete search history.

(56) References Cited

U.S. PATENT DOCUMENTS

| | | | | |
|---|---|---|---|---|
| 4,338,791 | A * | 7/1982 | Stamp, Jr. | F25B 49/02 165/242 |
| 4,353,409 | A * | 10/1982 | Saunders | F24F 11/08 165/217 |
| 6,715,304 | B1 * | 4/2004 | Wycoff | F25D 21/002 62/155 |
| 7,007,676 | B1 * | 3/2006 | Schuricht | F02D 41/222 123/359 |
| 2002/0007943 | A1 * | 1/2002 | Ozaki | B60H 1/00792 165/202 |
| 2003/0235306 | A1 * | 12/2003 | Fox | G06F 21/6209 380/255 |

(Continued)

FOREIGN PATENT DOCUMENTS

WO WO 2013/0993979 6/2013

OTHER PUBLICATIONS

Canadian Intellectual Property Office, Office Action for Application No. 2,860,648, 5 pages, dated Sep. 21, 2015.

(Continued)

*Primary Examiner* — Henry Crenshaw

(74) *Attorney, Agent, or Firm* — Baker Botts L.L.P.

(57) ABSTRACT

One aspect presents an controller that comprises a control board, a microprocessor located on and electrically coupled to the control board, and a memory coupled to the microprocessor and located on and electrically coupled to the control board. The controller is configured to receive a trip signal from a refrigerant high pressure sensor and set a maximum heating % demand of the heat pump system based on the trip signal, recalculate a heating % demand based on at least one of the recalculated heating % demand or the maximum heating % demand.

21 Claims, 4 Drawing Sheets

(56) References Cited

U.S. PATENT DOCUMENTS

| | | | | |
|---|---|---|---|---|
| 2005/0103874 | A1* | 5/2005 | Erdman, Jr. | F24F 11/0086 236/51 |
| 2006/0042282 | A1 | 3/2006 | Ludwig et al. | |
| 2007/0144193 | A1* | 6/2007 | Crane | F25B 49/022 62/228.4 |
| 2008/0134699 | A1* | 6/2008 | Leaver | F25B 41/062 62/129 |
| 2009/9173984 | | 7/2009 | Taguchi | |
| 2010/0042074 | A1* | 2/2010 | Weston | A61M 1/0066 604/543 |
| 2010/0275628 | A1* | 11/2010 | Moseley | F04B 49/10 62/228.1 |
| 2011/0219797 | A1 | 9/2011 | Taguchi | |
| 2014/0331702 | A1* | 11/2014 | Tanaka | F25B 49/027 62/159 |

OTHER PUBLICATIONS

European Communication and Search Report; Application No. 14185194.9—1602; 6 pages, dated Apr. 7, 2015, Received May 20, 2015.

Canadian Intellectual Property Office Official Action dated Jul. 22, 2016 in Canadian Application No. 2,860,648, 4 pages.

* cited by examiner

HEAT PUMP SYSTEM HAVING A PRESSURE TRIP SENSOR RECALCULATION ALGORITHM CONTROLLER

TECHNICAL FIELD

This application is directed to heating, ventilation, and air conditioning (HVAC) heat pump systems.

BACKGROUND

Heat pump (HP) systems have gained wide commercial use since their first introduction into the HVAC market because of their operational efficiency and energy savings, and it is this efficiency and energy savings that appeals to consumers and is most often the deciding factor that causes them to choose HPs over conventional HVAC furnace systems. During the winter, a HP system transfers heat from the outdoor air heat exchanger to an indoor heat exchanger where the heat is used to heat the interior of the residence or building. The consumer uses a thermostat to select a temperature set-point for the interior, and the HP then operates, using heat transferred from the outside, to warm the indoor air to achieve the set-point. As a result, the consumer enjoys a heating capability, while saving energy. Though auxiliary heating systems, such as electric or gas furnaces can be used in conjunction with the HP, this is typically done only for a brief period of time in order to achieve the set-point in extremely cold conditions.

SUMMARY

One embodiment of the present disclosure presents a HP system that comprises an indoor blower/heat exchanger (ID) system and an outdoor fan/heat exchanger and compressor (OD) system. The ID system and the OD system are fluidly coupled together by refrigerant tubing that forms a refrigerant system. The system also comprises a refrigerant high pressure sensor located on the refrigerant tubing and is configured to provide a trip pressure signal of the refrigerant system. A controller is coupled to the HP system and is configured to receive the trip signal from the refrigerant high pressure sensor and set a maximum heating % demand of the heat pump system based on the trip signal, recalculate a heating % demand based on at least one of the recalculated heating % demand or the maximum heating % demand.

Another embodiment of the present disclosure is a controller. This embodiment comprises a control board, a microprocessor located on and electrically coupled to the control board, and a memory coupled to the microprocessor and located on and electrically coupled to the control board. The controller comprises a memory coupled to the microprocessor and is located on and electrically coupled to the control board and has a compressor controller coupled to a compressor of an outdoor (OD) system of a HP system. The controller is further coupled to a refrigerant high pressure sensor of the HP system and is configured to receive a trip signal from the refrigerant high pressure sensor and set a maximum heating % demand of the heat pump system based on the trip signal, recalculate a heating % demand based on at least one of the recalculated heating % demand or the maximum heating % demand.

Another embodiment presents a computer program product, comprising a non-transitory computer usable medium having a computer readable program code embodied therein, the computer readable program code adapted to be executed to implement a method of measuring and managing an indoor airflow rate of a heat pump system. The method comprises setting a max-mum heating % demand of the HP system based on the trip signal, recalculating a heating % demand based on at least one of the recalculated heating % demand or the maximum heating % demand.

BRIEF DESCRIPTION

Reference is now made to the following descriptions taken in conjunction with the accompanying drawings, in which.

DETAILED DESCRIPTION

Figure 1:
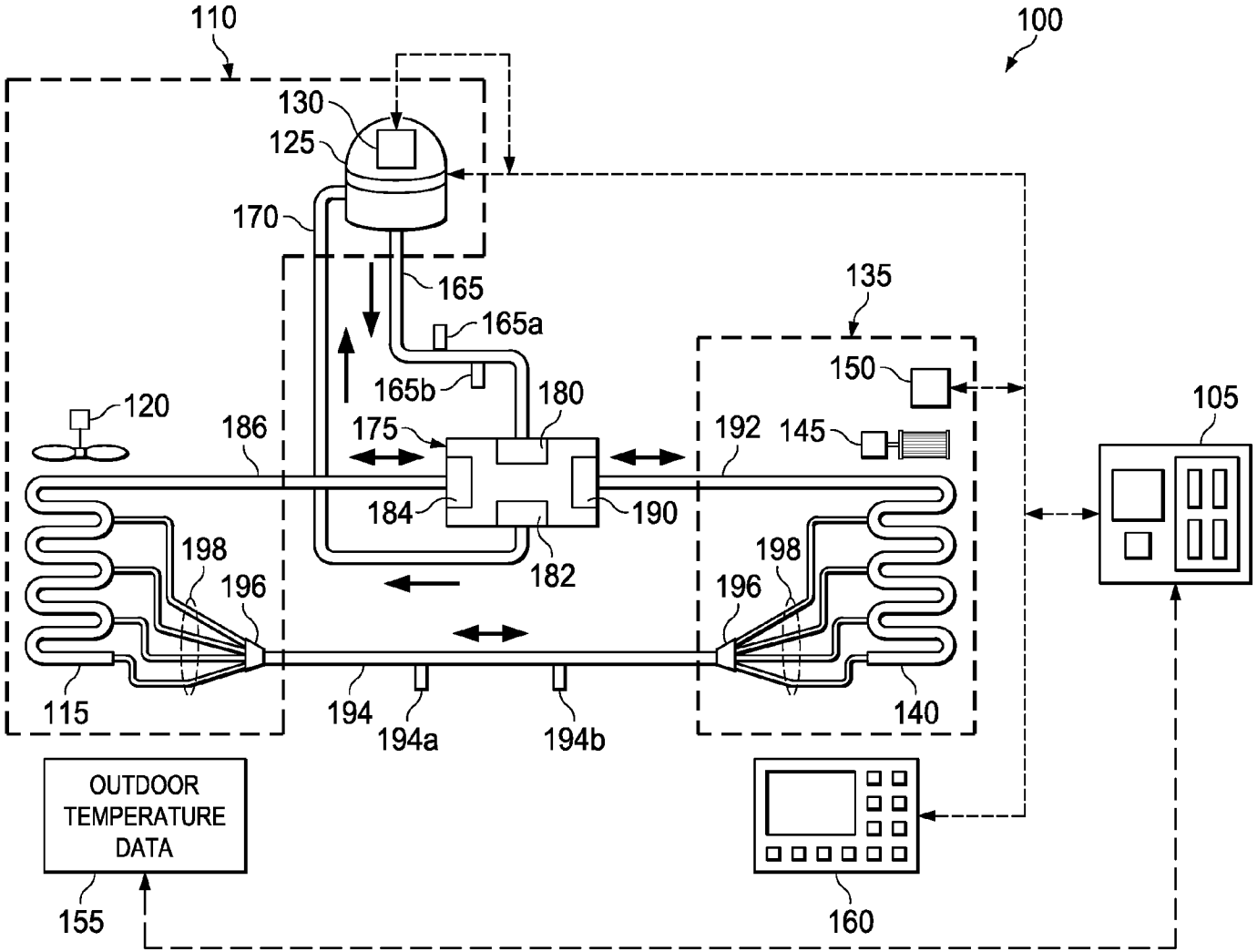
FIG. 1 illustrates a block diagram of an example HP system in which the controller of this disclosure may be implemented.

As noted above, HP systems have gained wide use and are popular with consumers because they can reduce energy costs by using the heat in outdoor air to heat the space of an indoor structure, such as a residence or business. Though these HP systems are typically very efficient in operation and energy savings, there are drawbacks. One such drawback is that, in certain operational modes where the HP system is attempting to reach an indoor temperature set point, as demanded by the HP system's thermostat, the heating % demand of the HP system may be increased. Depending on the existing outdoor ambient temperature conditions, a higher heating % demand can result, for example, in a higher compressor discharge pressure. If the discharge pressure causes the pressure within the refrigeration line to exceed a predetermined maximum pressure, a refrigerant high pressure trip sensor is activated and sends a signal to cause the HP system to shut down or substantially reduce heating % demand.

In these conventional HP systems, the HP system attempts to achieve the indoor temperature set point typically by ramping the heating % demand up by a set percentage, for example, 5% every set period of time, such as every 2 minutes, until the indoor temperature set point is met or until the HP system shuts down due to exceeding a maximum discharge pressure of the compressor. The shutdown, which may be temporary in certain systems, occurs when the HP system's controller receives a signal from a refrigerant high pressure sensor. For example, if the refrigerant high pressure sensor trips, the HP system can drop maximum heating % demand by a set amount, e.g., 25%, or shutdown and wait about 5 minutes and then re-start. Even after re-start, however, the HP system will drive its operations unabated until another trip signal occurs. Such conventionally controlled HP systems can continue to cycle in either of these two ways, resulting in undesirable fluctuating heating or a service call by the user.

To address these operational disadvantages, the embodiments of the current disclosure present a controller that uses the conditions of the HP system at the time of a trip signal to establish a new maximum heating % demand for the HP system. The maximum heating % demand is the maximum heating capacity the HP system is designed to reach without potentially harming the system or causing a system shutdown. The heating % demand is the amount of heat the HP system is demanding to reach the desired indoor temperature set point. The trip signal may be generated by one or more sensors, such as pressure sensors, transducers, or temperature sensors that monitor operations of various components of the HP system, such as compressor discharge pressure, refrigerant line pressure, or outdoor or indoor fan speeds. In one embodiment, the trip signal is generated by a refrigerant line pressure sensor. The controller sets the heating % demand at the occurrence of the trip signal as the new maximum heating % demand from which a recalculated heating % demand is determined. The controller then operates the HP system based on either one or both of these values. For example, the controller may operate the HP system based on the recalculated heating % demand, while the new maximum heating % demand serves as the new upper operational limit of the HP system. In one embodiment, when the trip signal occurs, the operational parameters of the various HP system components, such as the indoor or outdoor fan speeds, compressor speed, or refrigerant line pressure are stored in a memory accessible by the controller. Any of these operational parameters, or a combination thereof, may be used as the basis for determining the recalculated heating % demand for the HP system, which is less than the new maximum heating % demand set by the controller at the time the trip signal is generated.

In one embodiment, after the recalculated heating % demand is determined, the controller then operates the HP system by varying one or more of the operational parameters of the above mentioned components to cause the HP system to approach the new maximum heating % demand in a more controlled incremental manner than prior to the generation of the trip signal. The increments may be a set percentage that changes over a period of time, or it may be a varying percentage value that changes over a period of time. In another aspect of these embodiments, the incremental changes are not time dependent.

In other embodiments, the controller may further operate the HP system after the determination of the recalculated heating % demand in such a manner that when the HP system reaches a predetermined heating % demand value that is less than the new maximum heating % demand, the controller will not increase the operational parameters of the HP system further so as to avoid exceeding the new maximum heating % demand, thereby avoiding further inadvertent shutdowns of the HP system. In yet another embodiment, if the HP system has operated for an extended time at reduced operating conditions based on the recalculated heating % demand, the controller may reset the HP system to the original maximum heating % demand conditions that existed before any trip conditions occurred. In yet another embodiment, if the HP system has operated for an extended time at reduced operating conditions based on the recalculated heating % demand, and unable to reach within an acceptable range of the set point, the controller may reset the HP system to the original maximum heating % demand conditions that existed before any trips conditions occurred. Alternatively, the outdoor ambient temperature may have changed sufficiently to allow the HP system to operate under normal conditions, and if so, the controller may reset the HP system to the original operating parameters. Thus, the embodiments of the controller provide greater control over the way in which the recalculated heating % demand is approached by the HP system, and thus, lessens the occurrence of another trip signal.

In one embodiment, the controller may cause the HP system to approach the recalculated heating % demand by 1% every two minutes in which the indoor temperature set point is not met. In another embodiment, the controller may cause the HP system to approach the recalculated heating % demand by 3% every two minutes in which the indoor temperature set point is not met, then by 1.5% every 3 minutes, then by 0.75% every 4 minutes, etc., until the HP system either reaches the predetermined value noted above, re-sets the HP system, or experiences a second shutdown. In those embodiments, where the controller is configured to allow a second shutdown event, the controller may perform a second recalculation of the heating % demand in a similar manner as described above. However after a second trip, the heating % demand at the second trip then becomes the second new maximum heating % demand, which is then set by the controller and used to provide a second recalculated heating % demand for the HP system. It should be noted that the number of above-described recalculations may vary and that the percentages and times given above are for purposes of providing examples only and that these values may vary depending upon the design of the HP system.

In certain embodiments, the HP system may have a single refrigeration high pressure sensor. In other embodiments, it may have first and second refrigeration high pressure sensors, in which the first refrigeration high pressure sensor has a lower pressure setting than the second refrigeration high pressure sensor, which may act as a default or fail-safe pressure sensor for the HP system. In one embodiment, if, during operation, the indoor air temperature set point is not achieved, the HP system will increase the operational parameters of one or more of the HP system's components in an attempt to achieve the set point by increasing the heating % demand of the HP system to reach the set point. During this time, the first refrigeration high pressure sensor may trip and send a first trip signal. The controller will then use the conditions at that trip to establish a new maximum heating % demand, which is used as the new upper operational limits of the HP system. If a second pressure sensor is present and the HP system's operations exceed the new maximum heating % demand for some reason, due to system fluctuations or drift, etc., and trips the second refrigeration high pressure sensor, the HP system may go into a full shut down mode for a predetermined period of time or until re-started by the user or a technician.

One embodiment of the controller, as implemented in a HP system 100, is illustrated in FIG. 1. FIG. 1 illustrates a block diagram of an example of the HP system 100 in which a controller 105, as provided by embodiments described herein, may be used. Various embodiments of the controller 105 are discussed below. The HP system 100 comprises an outdoor (OD) system 110 that includes a heat exchanger 115, equipped with an outdoor fan 120, which in certain embodiments may be a conventional variable speed fan, a compressor 125, and an optional outdoor controller 130, coupled to the OD system 110. When present, the outdoor controller 130 may be coupled to the OD system 110 either wirelessly or by wire. For example, the outdoor controller 130 may be coupled to either the compressor 125 or the fan 120, or both. In the illustrated embodiment, the outdoor controller 130 is attached directly to the compressor 125 and is coupled to the compressor 125 by wire. If the outdoor controller 130 is not present, it may be controlled by the controller 105.

The HP system 100 further includes an indoor (ID) system 135 that comprises an indoor heat exchanger 140, equipped with an indoor blower 145, which in certain embodiments, may be a conventional, variable speed blower, and an indoor system controller 150. The indoor system controller 150 may be coupled to the ID system 135 either wirelessly or by wire. For example, the indoor system controller 150 may be located on a housing (not shown) in which the blower 145 is contained and hard wired to the blower 145. Alternatively, the indoor system controller 150 may be remotely located from the blower 145 and be wirelessly connected to the blower 145. The indoor system controller 150 may also be optional to the system, and when it is not present, the indoor system 135 may be controlled by the controller 105.

The HP system 100 further includes an outdoor temperature data source 155 that is coupled to the controller 105. In one embodiment, the outdoor temperature data source 155 may be a temperature sensor located adjacent or within the OD system 110 and coupled to controller 105 either wirelessly or by wire. For example, the temperature sensor may be located on the same board as the outdoor controller 130. In an alternative embodiment, the temperature data source 155 may be an internet data source that is designed to provide outdoor temperatures. In such instances, the controller 105 would include a communication circuit that would allow it to connect to the internet through either an Ethernet cable or wirelessly through, for example a Wi-Fi network.

The HP system 100 further includes a thermostat 160, which, in certain embodiments may be the primary controller of the HP system 100, that is, the controller 105 may be located within thermostat 160. The thermostat 160 is preferably an intelligent thermostat that includes a microprocessor and memory with wireless communication capability and is of the type described in U.S. Patent Publication, No. 2010/0106925, application Ser. No. 12/603,512, which is incorporated herein by reference. The thermostat 160 is coupled to the outdoor controller 130 and the indoor controller 150 to form, in one embodiment, a fully communicating HP system, such that all of the controllers or sensors 105, 130, 150, 155, and 160 of the HP system 100 are able to communicate with each other, either by being connected by wire or wirelessly. In one embodiment, the thermostat 160 includes the controller 105 and further includes a program menu that allows a user to activate the HP system 100 by selecting the appropriate button or screen image displayed on the thermostat 160. In other embodiments, the controller 105 may be on the same board as the outdoor controller 130 or the indoor controller 150. Thus, the controller 105 may be located in various locations within the HP system 100.

In general, the compressor 125 is configured to compress a refrigerant, to transfer the refrigerant to a discharge line 165, and, to receive the refrigerant from a suction line 170. The discharge line 165 fluidly connects the compressor 125 to the outdoor heat exchanger 115, and the suction line 170 fluidly connects the indoor heat exchanger 140 to the compressor 125 through a reversing valve 175. The reversing valve 175 has an input port 180 coupled to the discharge line 165, an output port 182 coupled to the suction line 170, a first reversing port 184 coupled to a transfer line 186 connected to the outdoor heat exchanger 115, and a second reversing port 190 coupled to a second transfer line 192 connected the indoor heat exchanger 140. As understood by those skilled in the art, the transfer lines 186, 192 allow for the reversal of the flow direction of the refrigerant by actuating the revering valve 175 to put the HP system 100 in a cooling mode or a heating mode. One skilled in the art would also appreciate that the HP system 100 could further include additional components, such as a connection line 194, distributors 196 and delivery tubes 198 or other components as needed to facilitate the functioning of the system.

In addition, the HP system 100 includes one or more conventional refrigerant high pressure sensors 194*a*, 194*b* located on the connection line 194, or sensors 165*a*, 165*b* located on the discharge line 165, or some combination of the two. The refrigerant high pressure sensors, as noted above, are configured to generate a trip signal when the pressure within the connection line 194 or discharge line 165 exceeds a set high pressure limit of the HP system 100. When two refrigerant high pressure sensors are present, a first sensor has a lower pressure setting than the second sensor and may be located adjacent the secondary refrigerant high pressure sensor. In the embodiments where two refrigerant high pressure sensors are present, the first refrigerant high pressure sensor may be configured to govern the HP system 100 when operating in the above-discussed limit modes and the second refrigerant high pressure sensor can act as a fail-safe or safety net pressure sensor for the HP system.

Figure 2:
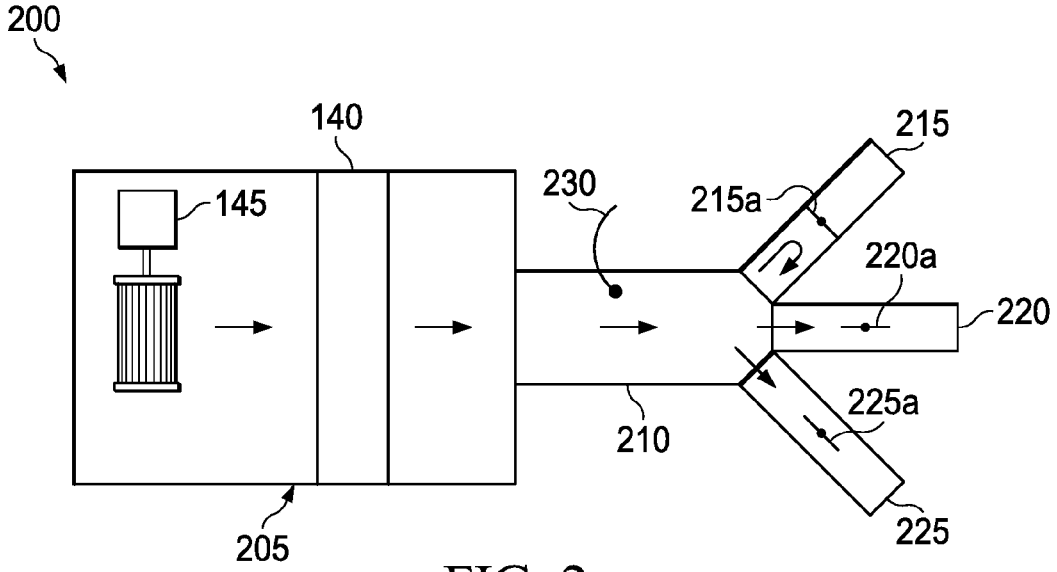
FIG. 2 shows a schematic diagram of a multi-zoned plenum system that may form a portion of the HP system of FIG. 1.

FIG. 2 illustrates a schematic view of a conventional multi-zone plenum 200, which may be present in certain HP system 100 configurations. In the illustrated embodiment, the plenum comprises a distribution plenum 205, in which is located the indoor blower 145 and the indoor heat exchanger 140 of the HP system 100 of FIG. 1. The distribution plenum 205 has a primary feed duct 210 coupled to it through which indoor air passes from the distribution plenum 205 to zoned ducts 215, 220 and 225, and in which a conventional thermocouple 230 is located to measure the temperature of the airflow from the distribution plenum 205. The zoned ducts may be of conventional design and include conventionally controlled air dampers 215*a*, 220*a*, and 225*a*, respectively. The air dampers 215*a*, 220*a*, and 225*a* may be controlled by the controller 105, thermostat 160, or another controller associated with the HP system 100. The present invention is applicable in multi-zoned systems, because often times, the airflow demand, in one zone may be lower than the airflow demand in another zone. In such instances, the damper to the zone having a different airflow demand may be closed, while the dampers to the other zones remain open, as illustrated in FIG. 2. When such conditions exist, the overall indoor airflow rate is reduced, which can make it more difficult to reach temperature set points. As a result, the compressor discharge pressure can increase enough to cause the refrigerant high pressure sensor to trip and either reduces the operation of or shuts down the HP system 100.

However, when the HP system 100 includes embodiments of the controller 105 of the present disclosure, shutdown or reduced operation of the HP system 100, which might normally occur under such circumstances, can be prevented. If during the HP system's 100 attempts to achieve the indoor temperature set point, a trip signal is generated, the controller 105 will establish a new maximum heating % demand and set the recalculated heating % demand to a lower value, for example 75% of the new maximum heating % demand, which is the heating % demand at the occurrence of the trip signal. As the HP system continues its operation to achieve the indoor air temperature set point, the controller 105 will operate the HP system 100 to incrementally approach the new maximum heating % demand or the recalculated heating % demand. The increments by which each value is recalculated may be done as discussed herein. The incremental fashion by which the values are recalculated lessens the chance of further high pressure trips and provides better control over the operation of the HP system.

Figure 3:
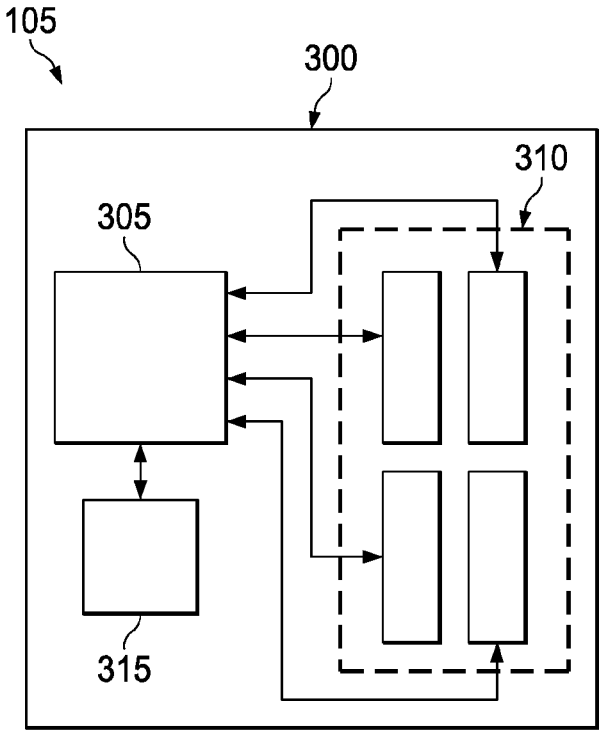
FIG. 3 shows a schematic of a layout diagram of an embodiment of the enhanced controller circuit board.

FIG. 3 illustrates a schematic view of one embodiment of the controller 105. In this particular embodiment, the controller 105 includes a circuit wiring board 300 on which is located a microprocessor 305 that is electrically coupled to memory 310 and communication circuitry 315. The memory 310 may be a separate memory block on the circuit wiring board 300, as illustrated, or it may be contained within the microprocessor 305. The communication circuitry 315 is configured to allow the controller 105 to electronically communicate with other components of the HP system 100, either by a wireless connection or by a wired connection. The controller 105 may be a standalone component, or it may be included within one of the other controllers previously discussed above or with another component controller of the HP system. In one particular embodiment, the controller 105 will be included within the thermostat 160. In those embodiments where the controller 105 is a standalone unit, it will have the appropriate housing and user interface components associated with it.

In another embodiment, the controller 105 may be embodied as a series of operational instructions that direct the operation of the microprocessor 305 when initiated thereby. In one embodiment, the controller 105 is implemented in at least a portion of a memory 310 of the controller 105, such as a non-transitory computer readable medium of the controller 105. In such embodiments, the medium is a computer readable program code that is adapted to be executed to implement a method of recalculating the heating % demand based on the current heating % demand at the time of receiving the trip signal. The method comprises setting a maximum heating % demand of the HP system 100 based on the trip signal, recalculating a heating % demand based on the maximum heating % demand and causing the HP system 100 to operate based on the recalculated heating % demand.

Figure 4:
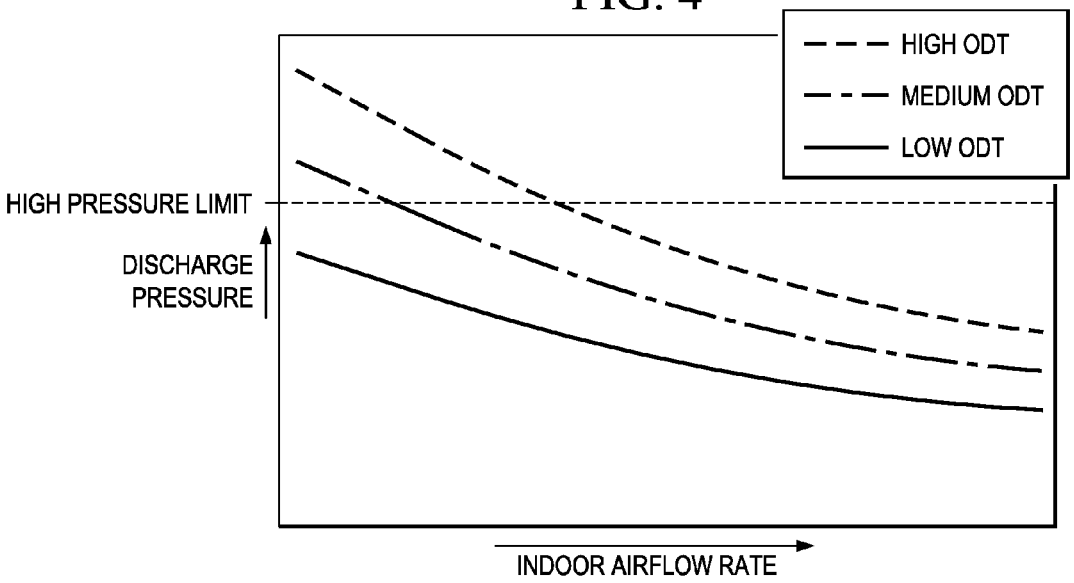
FIG. 4 is a graph showing the relationship between discharge pressure and indoor airflow rate at various outdoor ambient temperatures (ODT), where at low airflow rates, discharge pressure exceeds system high pressure limit.

FIG. 4 is a graph that relates the indoor airflow rate with the discharge high pressure and outdoor ambient temperature. As seen in FIG. 4, as the indoor airflow rate decreases, the discharge pressure increases. Thus, in one embodiment, as certain zones within a HP system are closed off, the indoor airflow rate is decreased, relative to the outdoor ambient temperature, which can cause the discharge pressure of the HP system to increase and generate a trip signal. The controller 105, when activated will recalculate the maximum heating % demand to a lower value in order to allow the HP system to continue to function and achieve the indoor temperature set point within the air conditioned space. The controller 105 may be activated by the user or a technician at the time of installation.

An advantage of the embodiments of the controller 105, as presented herein, is that the avoidance of excessive trip shutdowns can be achieved by less expensive controller software. The present controller not only simplifies design, but also reduces the costs associated with conventional controllers.

Figure 5:
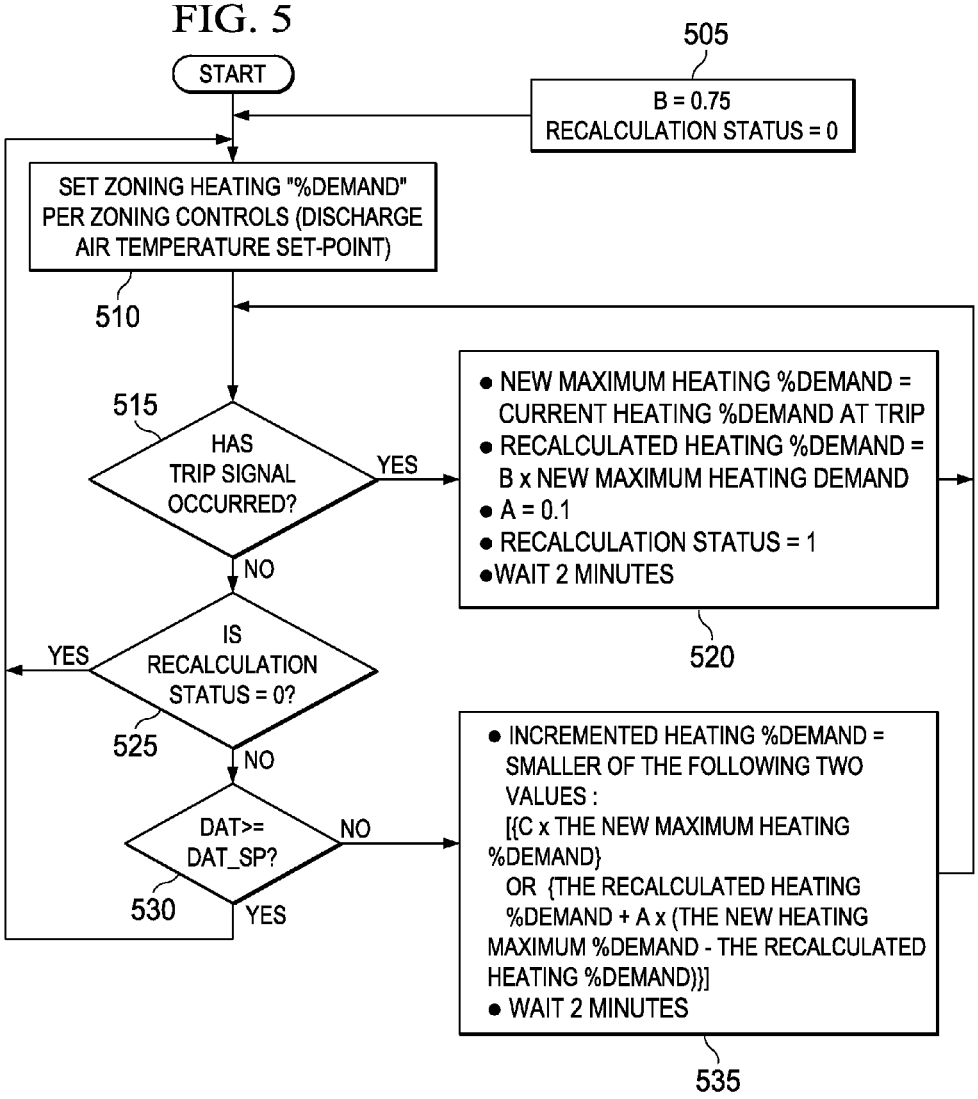
FIG. 5 presents a flow diagram of an example operation of a HP system having an embodiment of the controller, as provided herein, associated therewith.

FIG. 5 illustrates a flow chart of the operation of a HP implementing one embodiment of the controller 105, as provided herein. Step 505 represents one embodiment of a value 0.75 for variable B, which is accessible to the controller 105 and is the percentage that the controller 105 will use to establish the new recalculated heating % demand after a trip signal is generated. The above-stated exemplary value may vary from one HP system to another. At this point, the recalculation status is zero, since no recalculations have been performed at this point in the algorithm. At step 510, the zoning controls are set to the desired zoning heating % demand to meet the indoor temperature set point. The algorithm proceeds to step 515 to determine if a trip signal has occurred. If a trip signal has occurred, in step 520, the algorithm sets the heating % demand at trip as the new maximum heating % demand and then multiplies the new maximum heating % demand by a variable "B", which may be any number less than one and greater than zero. (e.g. 0.75, in one embodiment). The HP system may then be instructed to wait 2 minutes and then return to operation at step 515. In this same step 520, the algorithm sets the value of another variable "A" to be used in a later step in the algorithm, as described below. The recalculation status is also set to 1, since a recalculation has been performed. This cycle can repeat for a predetermined number of times. In such cases, the recalculation status will increase by the number of recalculations performed during this cycle.

If a trip signal has not occurred, then the algorithm proceeds to step 525 to determine if the recalculation status is zero (i.e., a recalculation has not occurred). If a recalculation has not occurred, or is zero, the algorithm returns to step 510. If a recalculation has occurred (i.e., number of recalculations is one or greater), the algorithm proceeds to step 530 to determine if the indoor temperature is greater than or equal to the indoor temperature set point. If yes, the algorithm returns to step 510. If no, the algorithm proceeds to an incrementing step 535 in which the controller sets the incremental heating % demand to be equal to the smaller of the following two values: [{C×the new maximum heating % demand} or {the recalculated heating % demand+"A"×(the new maximum heating % demand−the recalculated heating % demand}}]. "A" and "C," as used above, are variables whose values are between zero and one. Variable "A", represents the number of small increments taken when approaching the new maximum heating % demand. Following this incremental recalculation, the HP system is instructed to wait 2 minutes. This portion of the algorithm may also be repeated, with each incremented heating % demand value getting closer to the new maximum heating % demand, until the indoor temperature set point is met, or the value reaches a predetermined value less than the new maximum heating % demand, at which point, in one embodiment, the controller may reset the operating conditions of the HP system after a predetermined period of time.

Those skilled in the art to which this application relates will appreciate that other and further additions, deletions, substitutions and modifications may be made to the described embodiments.

What is claimed is:

1. A heat pump (HP) system, comprising:

an indoor blower/heat exchanger (ID) system;

an outdoor fan/heat exchanger and compressor (OD) system, said ID system and said OD system being fluidly coupled together by refrigerant tubing that forms a refrigerant system;

a refrigerant high pressure sensor located on said refrigerant tubing and configured to provide a trip signal of said refrigerant system when a discharge pressure of the OD system exceeds a pressure limit; and a controller coupled to said heat pump system and configured to:

receive said trip signal from said refrigerant high pressure sensor; and set a maximum heating % demand of said heat pump system based on a first heating % demand, said first heating % demand being a heating % demand at the time of said trip signal;

calculate a second heating % demand based on said maximum heating % demand; and cause said HP pump system to operate based on at least one of said second heating % demand or said maximum heating % demand.

2. The HP system of claim 1, wherein said refrigerant high pressure sensor is a first refrigerant high pressure sensor and said system further includes a second refrigerant high pressure sensor positioned on said refrigerant tubing, wherein said second refrigerant high pressure sensor is located adjacent said first refrigerant high pressure sensor and has a higher pressure limit than said first refrigerant high pressure sensor.

3. The HP system of claim 1, wherein said controller is configured to calculate at least a third heating % demand for said HP system after an occurrence of a second trip signal.

4. The HP system of claim 1, wherein:

prior to said trip signal, said HP system operates at an original heating % demand; and said controller is configured to reset said HP system to the original heating % demand.

5. The HP system of claim 1, wherein said controller calculates said second heating % demand, as follows:

second heating % demand=B×new maximum heating % demand, wherein:

B is a real number that is greater than zero and less than 1, and new maximum heating % demand is the heating % demand at the occurrence of said trip signal.

6. The HP system of claim 1, wherein said controller is configured to increment an operation of said HP system toward said second heating % demand as follows:

Incremented heating % demand=smaller of the following two values: [{C×the new maximum heating % demand} or {the second heating % demand+A×(the new maximum heating % demand−the second heating % demand)}], wherein:

A and C are variables that are less than one, but greater than zero.

7. The HP system of claim 6, wherein said controller is further configured to:

calculate said incremented heating % demand one or more times; and discontinue calculating said incremented heating % demand when a value of said incremented heating % demand reaches a predetermined value.

8. The HP system of claim 1, wherein said controller is located with a thermostat of said HP system.

9. The HP system of claim 1, wherein said controller is further configured to increment an operation of said HP system toward said second heating % demand in successive reduced increments.

10. The HP system of claim 1, including multiple demand zones and said second % heating demand is calculated based on a total indoor airflow demand of active zones of said multiple demand zones.

11. A heat pump (HP) system controller, comprising:

a control board;

a microprocessor located on and electrically coupled to said control board; and a memory coupled to said microprocessor and located on and electrically coupled to said control board and having a compressor controller coupled to a compressor of an outdoor (OD) system of a HP system and being couplable to a refrigerant high pressure sensor of said HP system and configured to receive a trip signal from said refrigerant high pressure sensor when a discharge pressure of the OD system exceeds a pressure limit and set a maximum heating % demand of said heat pump system based on a first heating % demand, said first heating % demand being a heating % demand at the time of said trip signal, calculate a second heating % demand based on said maximum heating % demand, and cause said HP system to operate based at least one of said second heating % demand or said maximum heating % demand.

12. The HP system controller of claim 11, wherein said controller is configured to calculate at least a third heating % percent demand for said HP system based on a second trip signal.

13. The HP system controller of claim 11, wherein said controller is located within a HP system thermostat.

14. The HP system controller of claim 11, wherein said controller calculates said second heating % demand, as follows:

second heating % demand=B×new maximum heating % demand, wherein:

B is a real number that is greater than zero and less than 1, and new maximum heating % demand is the heating % demand at the occurrence of said trip signal.

15. The HP system controller of claim 11, wherein said controller is configured to increment an operation of said HP system toward said second heating percent % demand as follows:

Incremented heating % demand=smaller of the following two values: [{C×the new maximum heating % demand} or {the second heating % demand+A×(the new maximum heating % demand−the second heating % demand)}], wherein:

A and C are variables that are less than one, but greater than zero.

16. The HP system controller of claim 11, wherein said controller is configured to reset said HP system to operating conditions prior to said trip signal.

17. The heat pump system controller of claim 11, wherein said controller is further configured to increment an operation of said HP system toward said second heating % demand in successive reduced increments.

18. The HP system controller of claim 11, further configured to calculate said second heating % demand based on indoor airflow demand of multiple airflow zones of said HP system.

19. The HP system controller of claim 11, further configured to receive said trip signal from either a first refrigerant high pressure sensor or a second refrigerant high pressure sensor.

20. The HP system controller of claim 19, wherein said first refrigerant high pressure sensor has a lower pressure limit than said second refrigerant high pressure sensor and said HP system controller is configured to receive a trip signal from said first refrigerant high pressure sensor before receiving a trip signal from said second refrigerant high pressure sensor.

21. A computer program product, comprising a non-transitory computer usable medium having a computer readable program code embodied therein, said computer readable program code adapted to be executed to implement a method of recalculating, measuring, and managing indoor airflow rate of a heat pump (HP) system, said method comprising:

setting a maximum heating % demand of said HP system based on a first heating % demand, said first heating % demand being a heating % demand at the time of a trip signal, calculating a second heating % demand based on said maximum heating % demand, and causing said HP system to operate based on at least one of said second heating % demand or said maximum heating % demand.

* * * * *